US006544059B1

(12) United States Patent
Clavier et al.

(10) Patent No.: US 6,544,059 B1
(45) Date of Patent: Apr. 8, 2003

(54) CONNECTOR FOR DISCHARGE LAMPS, ESPECIALLY FOR A MOTOR VEHICLE

(75) Inventors: Philippe Clavier, Bobigny Cedex (FR); Jean Marc Nicolaï, Bobigny Cedex (FR)

(73) Assignee: Valeo Vision, Bobigny Cedex (FR)

( * ) Notice: Subject to any disclaimer, the term of this patent is extended or adjusted under 35 U.S.C. 154(b) by 0 days.

(21) Appl. No.: 09/598,632

(22) Filed: Jun. 21, 2000

(30) Foreign Application Priority Data

Jun. 23, 1999 (FR) ..... 99 08125

(51) Int. Cl.[7] ..... H01R 13/53
(52) U.S. Cl. ..... 439/182; 439/181
(58) Field of Search ..... 439/181, 182, 439/186, 617, 618; 313/325

(56) References Cited

U.S. PATENT DOCUMENTS 3,716,819 A * 2/1973 Borth ..... 439/182
3,869,633 A 3/1975 Dumas et al. ..... 313/325
4,378,511 A 3/1983 Simovits, Jr. ..... 313/325

FOREIGN PATENT DOCUMENTS

EP 0 526 335 2/1993
FR 2 702 601 9/1994

OTHER PUBLICATIONS

French Search Report dated Mar. 16, 2000.

* cited by examiner

*Primary Examiner*—P. Austin Bradley
*Assistant Examiner*—Ross Gushi

(57) ABSTRACT

A connector for a motor vehicle discharge lamp has at least two electrical contacts for supplying the high tension and low tension electrodes of the lamp. In the absence of a lamp, when the connector is connected to a power supply module, arcing can occur within the connector. The connector includes means which impose a preferential path on the arcs other than a direct path between the contacts of the connector.

14 Claims, 4 Drawing Sheets

CONNECTOR FOR DISCHARGE LAMPS, ESPECIALLY FOR A MOTOR VEHICLE

FIELD OF THE INVENTION

The present invention relates to a connector for a discharge lamp, especially for a motor vehicle.

BACKGROUND OF THE INVENTION

Conventionally, such a connector includes a base which is adapted to receive the end cap of the discharge lamp and which has in its interior two metallic contact elements which are connected to a discharge lamp power supply circuit or ballast. When a lamp is in place in the connector, its electrodes are connected to the supply circuit through these contacts.

It can happen that a voltage is applied to the metallic contacts by the starting module of the supply circuit, even when no discharge lamp is fitted in the connector. Arcs are then set up within the connector, and this can involve substantial damage to the latter. In this connection the arcs can reach very high power.

Various solutions have previously been proposed in order to overcome this drawback. In particular, connectors have been proposed which have an internal resilient contactor which only closes the power supply circuit on the contacts when it is pushed by the fitting of a discharge lamp in the connector.

Solutions have also been proposed in which the supply circuit for the lamp only closes on the contacts through the low tension cap skirt of the lamp.

In addition, connectors have been proposed in which their internal metallic contacts are, in the absence of any lamp, capped by an electrically insulating removable element which is pushed away when a lamp is fitted in the connector.

These various solutions do however prove complicated to achieve, because they call for the incorporation of various electrical connections within the connector. They can also give rise to reliability problems.

DISCUSSION OF THE INVENTION

An object of the invention is to propose a solution which does not have the above mentioned disadvantages.

According to the invention, a connector for a discharge lamp, especially for a motor vehicle, comprising at least two electrical contacts for power supply to the high tension and low tension electrodes, respectively, of the said lamp, is characterised in that it includes means which, for arcs through which the power supply module to which the connector is connected is discharged when it applies a voltage to the said contacts with no lamp in place in the connector, impose a preferential path on the arc other than a direct path between the said contacts.

Such a connector may with advantage also have the various features of the invention set out below, either individually or in any technically possible combination:

- it includes means through which the current corresponding to the said arcs flows, and which limit the intensity of the said arcs;
- it includes a metallic element the disposition of which contributes to the imposition on the arcs of a preferential path other than a direct path between the contacts;
- a metallic element is connected to one of the electrical contacts such that the electrical arcs traverse it when the arcs are established in their preferential path;

- the said metallic element is such that the preferential path of the arcs is between the said metallic element and the contact to which it is not connected;
- a metallic element is such that it lies close to the contact to which it is not connected, when no lamp is in place in the connector;
- a metallic element is such that it is closer to the contact to which it is not connected than to the other contact, when no lamp is in place on the connector;
- a said metallic element is connected to the contact supplying the low tension electrode of the lamp when a lamp is fitted in the connector;
- one metallic element is a contact designed to supply a low tension electrode of the lamp;
- a metallic element is movable between a closed circuit position into which it is displaced by insertion of the lamp and an open circuit position in which it is maintained elastically when no lamp is fitted;
- a resilient lug extends substantially radially within the connector from a wall of the latter towards the contact which is adapted to supply the high tension electrode of the lamp;
- it includes at least two metallic elements, one of which is connected to the low tension electrode and the other to the high tension electrode, such that the electrical arcs are established in a preferential path between the two said metallic elements.

Further features and advantages of the invention will appear more clearly on a reading of the following detailed description of some preferred embodiments of the invention, which is given by way of non-limiting example only and with reference to the accompanying drawings.

DESCRIPTION OF PREFERRED EMBODIMENTS OF THE INVENTION

Figure 1A:
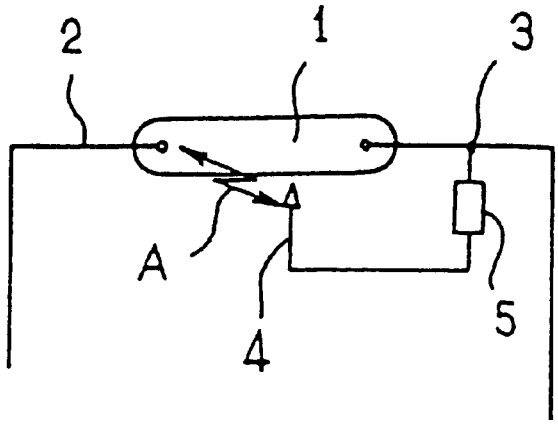
FIG. 1*a* is an electrical circuit diagram showing the principle of one possible embodiment of the invention.

The circuit in FIG. 1*a* comprises a discharge lamp 1 which has two electrodes, one of which is a low tension electrode and the other a high tension electrode. These latter are connected respectively to the power supply circuit of the discharge lamp through electrical contacts 2 and 3 of the connector. The two contacts 2 and 3 are referred to as the high tension and low tension contacts respectively in the rest of this description.

The circuit further includes a metallic element 4 which, when no lamp is in place in the connector, is disposed in the latter close to the high tension contact 2. The element 4 is connected to the low tension contact 3 via resistive means 5. Thus, if a high voltage is generated by the power supply circuit between the contacts 2 and 3 when the discharge lamp is not in place, the starting module for the power supply circuit discharges preferentially through an arc A, indicated by a zigzag double arrow in FIG. 1*a*, between the high tension contact 2 and the element 4, which is connected at the contact 3, but which is closer to the contact 2 than is the contact 3. In addition, the intensity of the current in such an electrical arc is limited by the resistive means 5. This enables any risk of destruction of the connector to be avoided.

Figure 1B:
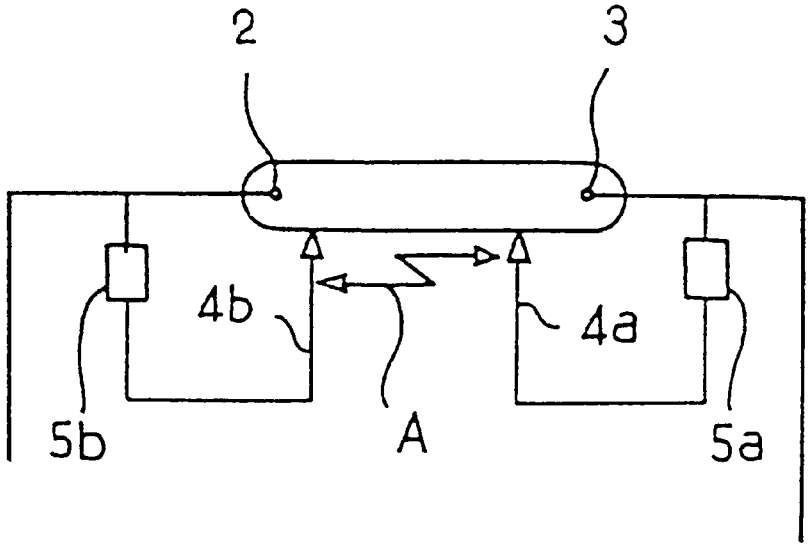
FIG. 1*b* is an electrical circuit diagram showing the principle of another possible embodiment of the invention.

FIG. 1*b* shows another possible embodiment of the invention, in which two metallic elements 4*a* and 4*b* are provided, which are connected electrically to the contact 2 and the contact 3 respectively, for example through suitable resistive means. The two metallic elements 4*a* and 4*b* are disposed facing each other, and separated by a distance which is smaller than the distance separating the contacts 2 and 3.

If, in the absence of a discharge lamp, a high voltage is generated between the contacts 2 and 3, the starting module discharges preferentially through an arc A between the elements 4*a* and 4*b* rather than by means of arcs between the contacts 2 and 3.

Resistive means 5*a* and 5*b* are interposed between the elements 4*a*, 4*b* and contacts 2 and 3 respectively to which they are connected.

Figure 2A:
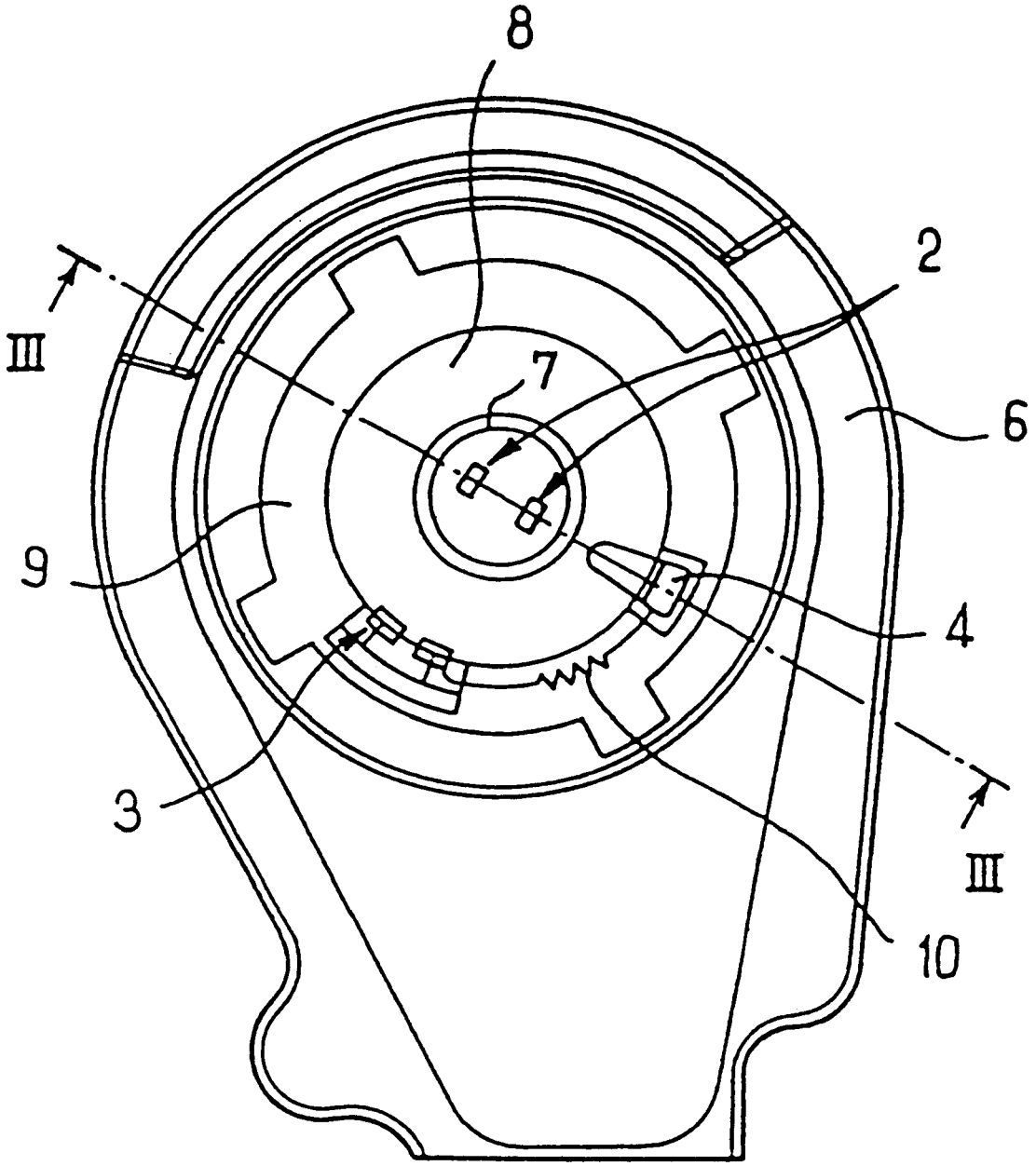
FIG. 2*a* is a diagrammatic bottom plan view of a connector in one possible embodiment of the version of the invention shown in FIG. 1*a*.
Figure 3A:
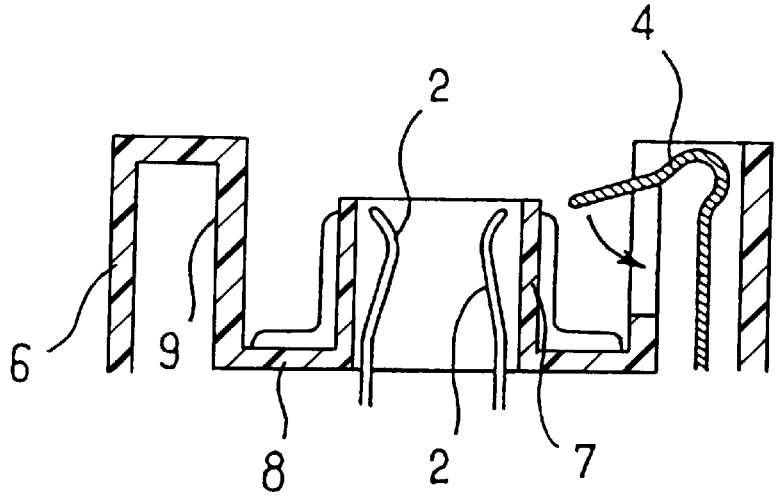
FIG. 3*a* is a diagrammatic representation in cross section taken on the line III—III in FIG. 2*a*.

Reference is now made to FIGS. 2*a* and 3*a*, showing a connector structure corresponding to the version shown in FIG. 1*a*. The connector shows in FIGS. 2*a* and 3*a* comprises a housing 6 which is so configured that it can receive and hold the end cap of a discharge lamp which is complementary to the connector. Its base 8 has a cylindrical central skirt 7, within which there are two metallic prongs which constitute high tension contacts 2 of the connector, and on which the base of the discharge lamp is arranged to bear.

The connector also includes, above the base 8, at least one metallic contact 3. In FIG. 2*a*, two contacts 3 are shown: these are the low tension contacts of the connector and are inserted in the wall 9 which defines the internal housing for receiving the end cap of the lamp. The contacts 3 are arranged to make contact with the skirt of the discharge lamp end cap when the lamp is in position.

The wall 9 also incorporates a resistive wire 10 which connects the contacts 3 to a resilient metallic lug that constitutes the element 4. This lug 4 consists of a metallic leaf which is bent back on itself and which projects from the wall 9 into the vicinity of the central skirt, and lies substantially in the diametral plane which is common to the two high tension contacts 2. Thus, the contacts 2 are closer to the resilient lug 4 than are the contacts 3.

Accordingly the resilient lug 4 is so positioned that the portions, of plastics material, between the contacts are not damaged. This is especially so as the wire resistor 10 (serving as the resistive means 5 in FIG. 1*a*) limits the current in the arcs.

It can also be arranged that the zones that correspond to the preferential paths of the arcs are reinforced zones so as to preserve a high integrity over time.

In addition, when a discharge lamp is positioned in the connector, its skirt comes into contact with the resilient lug 4, which it pushes towards the wall 9. The lug 4 thus constitutes a further low tension contact.

Figure 2B:
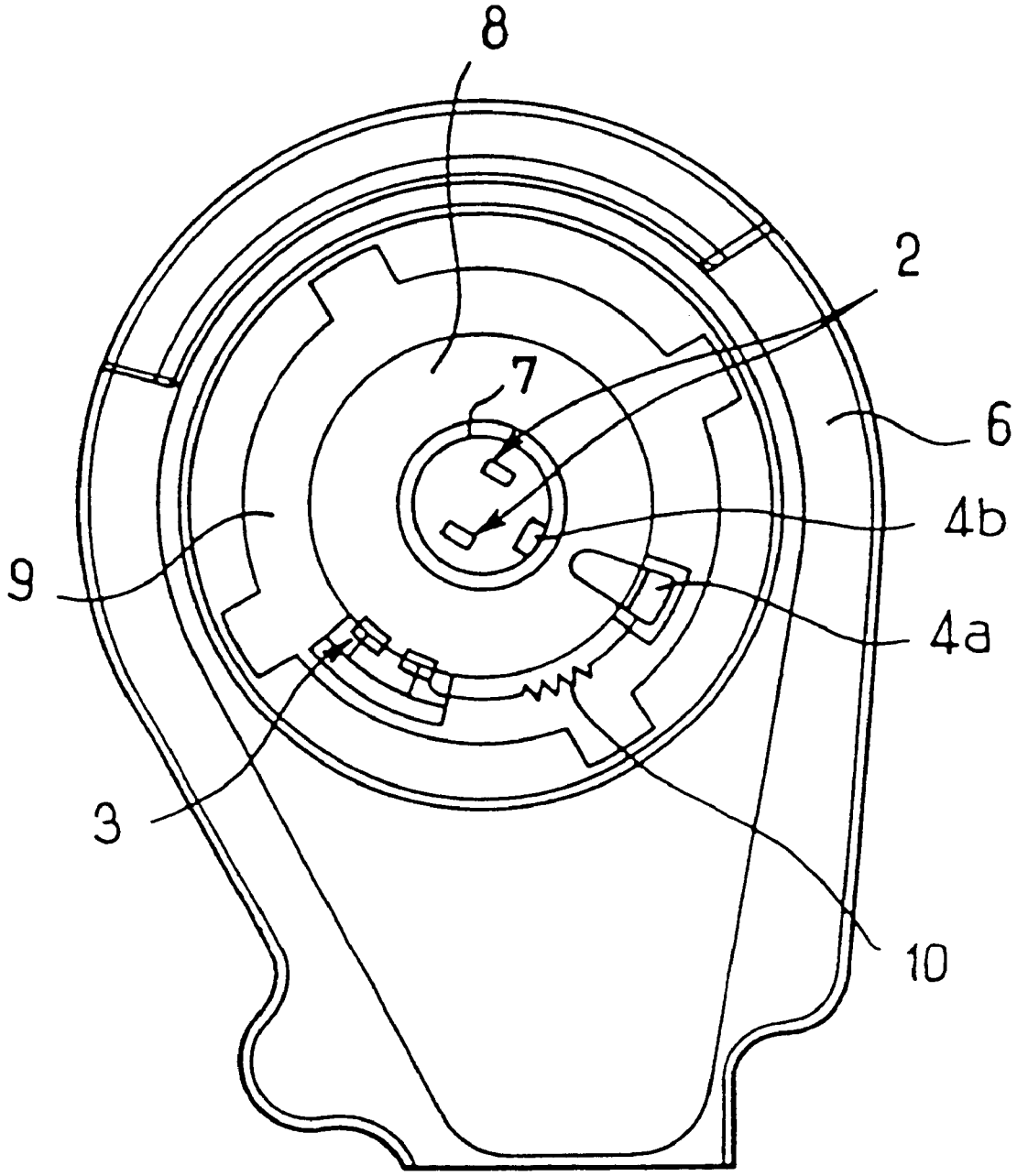
FIG. 2*b* is a bottom plan view of a connector in one possible embodiment of the version shown in FIG. 1*b*.
Figure 3B:
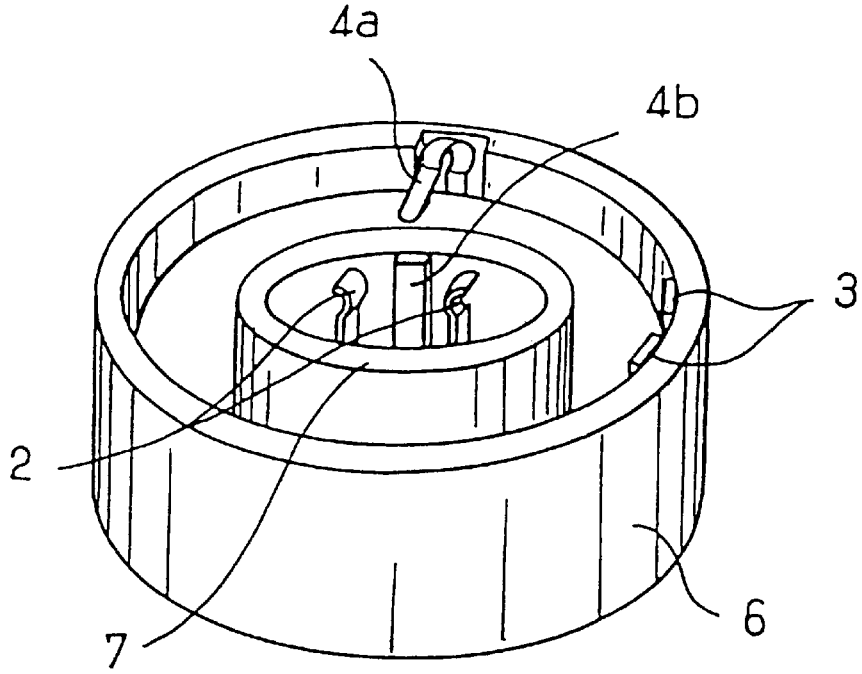
FIG. 3*b* is a diagrammatic perspective view of the connector in the embodiment of FIG. 2*b*.

Reference is now made to FIGS. 2*b* and 3*b*, which show a connector structure corresponding to the version of the invention shown in FIG. 1*b*. This connector structure is substantially similar to that just described with reference to FIGS. 2*a* and 3*a*. The common plane of the two contacts 2 is however here turned through a quarter turn, so that the contacts 2 are substantially aligned with the contacts 3.

The metallic resilient lug, which is here given the reference numeral 4*a* instead of 4, lies at right angles to this common plane, and the connector further includes another metallic element 4*b*, which consists of a metal leaf that lies within the height of the skirt 7, being just juxtaposed to the skirt 7 and within the latter. The leaf 4*b* lies directly facing the resilient lug 4*a*, and the distance between the leaf 4*b* and the end of the lug 4*a* is shorter than the distance between the contacts 2 and 3. The resistive means connecting the lug 4*b* to the contact 2, not shown in FIGS. 2*b* and 3*b*, are incorporated in the base of the connector.

As will already have been understood, the structures described above are particularly simple in construction. However, other versions can of course be envisaged. In particular, either or both of the resistors 5 and 10 may be replaced by any other means for limiting the current, for example by a VDR component. They may also consist of a resistive component incorporated in the wall 9 or, again, they may be defined by the dimensioning of the element 4 itself.

Equally, one or more metallic elements may be provided which are not necessarily connected to the contacts and which do not constitute elements on which the arcs are established. However they are disposed on the connector in such a way that they help to give the electrical arcs a preferential path other than a direct path between the contacts of the connector.

In addition, it will be noted that the protection means which have been described above can just as well be incorporated in high tension connectors for conventional discharge lamps as in high tension connectors with an integral power supply module.

What is claimed is:

1. A connector for holding a removable discharge lamp having a high tension electrode and a low tension electrode, the connector comprising at least two electrical contacts for supplying the lamp electrodes, the at least two electrical contacts having end portions adapted to contact the lamp electrodes when engaged, the connector being connectable via the contacts to a power supply module for the lamp, so that when said lamp is absent from the connector arcs may be established in the connector by discharge of the supply module, wherein the connector further comprises means, electrically connected with said contacts, for imposing on said arcs a preferential path from one of the end portions of the contacts other than a direct path between the contacts so as to reduce arcing along the direct path between the contacts when said lamp is absent from the connector.

2. A connector according to claim 1, comprising a current limiting element connected to at least one said contact so that current corresponding to the arcs can pass through the current limiting element to limit the intensity of the arcs.

3. A connector according to claim 1, comprising at least one metallic element electrically connected with at least one said contact and so disposed as to impose on said arcs a preferential path other than a direct path between the contacts.

4. A connector according to claim 3, wherein a said metallic element is a resilient element adapted to be engaged by a said lamp positioned in the connector, whereby to be moved resiliently between a closed circuit position to which the metallic element is displaced during insertion of the lamp into the connector, and an open circuit position in which it is maintained elastically.

5. A connector according to claim 4, comprising a circular wall and a resilient lug projecting substantially radially inwards form said wall towards the said contact associated with the high tension electrode of the lamp.

6. A connector according to claim 3, wherein a said metallic element is connected to a first one of said contacts so that current corresponding to said arcs pass through it when said arcs are established in their preferential path.

7. A connector according to claim 6 comprising first and second metallic elements for connection to said low tension and high tension electrodes respectively, and configured in such a way that the arcs are established in a said preferential path between the metallic elements connected to the first and second electrodes respectively.

8. A connector according to claim 6, wherein a said metallic element is connected to the contact associated with the low tension electrode of the lamp when a lamp is fitted in the connector.

9. A connector according to claim 8, wherein a said metallic element is adapted to supply a low tension electrode of the lamp.

10. A connector according to claim 6, wherein a said metallic element is such that the preferential path is between the said metallic element and a second said contact.

11. A connector according to claim 10, wherein a said metallic element is such that it is adjacent to the said second when a lamp is absent from the connector.

12. A connector according to claim 10, wherein a said metallic element is closer to the said second contact than to the said first contact when a said lamp is absent from the connector.

13. A connector for holding a removable discharge lamp having a high tension electrode and a low tension electrode, the connector comprising at least two electrical contacts for supplying the lamp electrodes, the at least two electrical contacts having end portions adapted to contact the lamp electrodes when engaged, the connector being connectable to a power supply module for the lamp, so that when the lamp is absent from the connector an arc may be established in the connector by discharge of the supply module, the connector further comprising at least one electrically conductive member, electrically connected with at least one said contact and so disposed as to impose on said arc a preferential path from one of the end portions of the contacts to the electrically conductive member other than a direct path between the contacts so as to reduce arcing along the direct path between the contacts when said lamp is absent from the connector.

14. A connector according to claim 13 comprising an impedance member connected to at least one said contact so that current corresponding to said arc can pass through the impedance member to limit the intensity of the arc.

* * * * *